US009045865B2

(12) United States Patent
Wang et al.

(10) Patent No.: US 9,045,865 B2
(45) Date of Patent: Jun. 2, 2015

(54) POLYMER GROUTING METHOD FOR UPLIFTING BALLASTLESS TRACK OF HIGH-SPEED RAIL

(71) Applicant: Henan Polytech Infrastructure Rehabilitation LTD., Zhengzhou, Henan (CN)

(72) Inventors: Fuming Wang, Henan (CN); Mingsheng Shi, Henan (CN); Yanhui Zhong, Henan (CN); Xiaolong Li, Henan (CN); Xiaoliang Wang, Henan (CN); Xianfeng Zhao, Henan (CN)

(73) Assignee: SAFEKEY Engineering Technology(Zhengzhou), Ltd., Zhengzhou, Henan (CN)

( * ) Notice: Subject to any disclaimer, the term of this patent is extended or adjusted under 35 U.S.C. 154(b) by 0 days.

(21) Appl. No.: 13/866,023

(22) Filed: Apr. 19, 2013

(65) Prior Publication Data

US 2014/0314502 A1 Oct. 23, 2014

(51) Int. Cl.
*E01B 1/00* (2006.01)

(52) U.S. Cl.
CPC ..... *E01B 1/002* (2013.01); *E01B 2204/03* (2013.01)

(58) Field of Classification Search
CPC ..... B05D 7/22; E02D 3/00; E02D 3/12; E01B 1/002; E01B 2204/03
USPC ..... 405/233, 266, 267, 269, 302.4; 238/2, 238/281; 166/302
See application file for complete search history.

(56) References Cited

U.S. PATENT DOCUMENTS

| | | | | |
|---|---|---|---|---|
| 8,272,811 | B2 * | 9/2012 | Wang et al. | 405/267 |
| 8,293,325 | B2 * | 10/2012 | Wang et al. | 427/236 |
| 2004/0109730 | A1 * | 6/2004 | Moss et al. | 405/263 |
| 2009/0304457 | A1 * | 12/2009 | Shimada et al. | 405/269 |
| 2011/0103898 | A1 * | 5/2011 | Wang et al. | 405/266 |

FOREIGN PATENT DOCUMENTS

CN 101261265 A * 9/2008

OTHER PUBLICATIONS

Cai et al.; CN 101261265A; Sep. 2008; Machine Translation; All.*
Wang, Jijun; The Blalastless Track Technology For China High-Speed Line; May 2011; All.*

* cited by examiner

*Primary Examiner* — Benjamin Fiorello

(57) ABSTRACT

A polymer grouting method for uplifting a ballastless track of a high-speed rail includes following steps of: (1) drilling grouting holes; (2) manufacturing geo-textile bags and binding the grouting pipes up with the geo-textile bags; (3) tying up the geo-textile bags; (4) displacing the geo-textile bags; (5) grouting two-component expansive polymer materials into the geo-textile bags; (6) uplifting the track; (7) grouting two-component expansive polymer materials for filling; and (8) monitoring amount of the uplifting, wherein a vertically uplifting height is monitored in real time by a laser level, and the grouting is quit if the vertically uplifting height meets uplifting requirements.

1 Claim, 6 Drawing Sheets

POLYMER GROUTING METHOD FOR UPLIFTING BALLASTLESS TRACK OF HIGH-SPEED RAIL

BACKGROUND OF THE PRESENT INVENTION

1. Field of Invention

The present invention relates to a field of repairing and maintaining transportation infrastructures, and more particularly to a polymer grouting method for uplifting a ballastless track of a high-speed rail.

2. Description of Related Arts

With the steady and sound development of economic constructions, high-speed rail in China is entering a rapid development stage. Since the construction of Qinshen Passenger Railway in 1999, China has built a high-speed railway network which has the largest scale and the highest running speed all over the world by constructing new railways and speeding up conventional railways for over a decade. By the end of December 2012, the high-speed rail which is over 200 km/h is nearly 13,000 km long in China, in which near 3,000 km is by speeding up conventional railways, and the highest running speed designed has reached 350 km/h. According to the National Medium and Long Term Planning Scheme of Railway Network of China, by the end of 2015, 42 passenger-dedicated lines of high-speed railway will be built, and a national high-speed transportation net work will be basically completed, with "four vertical and four horizontal" railways as a skeleton thereof, and a total mileage of more than 15,000 km; by 2020, the mileage of high-speed railway with a speed of more than 200 km/h will be more than 30,000 km in China.

To guarantee the high-speed, safe and smooth running of trains, high-speed rail requires extreme track regularity. If track irregularity degree exceeds design standards, the degree of comfort will be reduced greatly, and even endanger traffic safety if serious, which will inevitably result in slowing down the train speed and restricting the improvement of high-speed rail service. Studies have shown that for trains running at a speed of more than 300 km/h, 10 mm amplitude (wavelengths 40 m) track irregularity will produce in the train continuous vertical vibrations with a frequency of 2 Hz and an acceleration of 1.76 $m/s^2$, which are 3 to 5 times of the specified value by the international vibration environment standard ISO2631 (acceleration of 0.34 to 0.49 $m/s^2$), and this will cause extreme discomfort in the passengers. When traveling at a high speed, track irregularity induced by roadbed settlement will cause huge wheel-rail force and impact force. For example, when a train travels at a speed of 300 km/h, even step-like irregularity on the wheels as tiny as 0.2 mm will produce a 722 kN track rail high-frequency force and a 321 kN low-frequency track rail force, which will accelerate the breaking of track ballast, cause uneven settlement in the roadbed, and may also cause fractures in the rails, wheels and shafts, or cause vicious derailment accidents.

In order to guarantee track regularity, plate ballastless track is commonly used in the construction of modern high-speed rail. The plate ballastless track is a new type of track structure in which the concrete supporting layers, emulsified asphalt cement mortar layers, precast concrete track plates, plate connectors, rail and fasteners are cast-in-place in the roadbed.

Compared with traditional ballasted track, ballastless track structure, without any track sleepers and track bed, and utilizing precast reinforced concrete plates to support the rail directly, has many outstanding advantages such as: good stability and regularity; low building height and light weight that reduces bridge secondary loads and tunnel clearance; slow track deformation and good durability; requiring no maintenance or low maintenance with low costs. Therefore, ballastless track structure has become the mainstream model and the inevitable trend of modern high-speed railway construction, and has been widely utilized in high-speed rail construction of China. More than ten newly built high-speed railways (including passenger-dedicated lines) utilizes ballastless tracks, such as Hada line, Jinghu line, Jingshiwu line, Haqi line, Ninghang passenger-dedicated line, Hebeng passenger-dedicated line, Hangyong line, Zhengxi line and etc.

The advantages of ballastless track are very prominent, but at the same time the ballastless track also requires high quality of basic civil engineering construction, especially high roadbed construction quality. According to the newest High-speed Rail Design Specification (TB 10621-2009), post-construction settlement of ballastless track should not exceed 15 mm (ordinary railway with a design speed of 160 km/h requires no more than 200 mm of post-construction settlement). This strict specification on roadbed settlement deformation of high-speed rail ballastless track has become the main controlling factor to be considered for the design and construction of rail lines.

Due to the vast territory and complex geological conditions of China, a large number of high-speed rail lines have to pass through adverse geological zones such as soft soil, loess, and Karst caves. Therefore roadbed settlement is very common, especially in economically developed areas in China, such as coastal areas, areas near lakes or rivers where soft soil commonly develops. Due to the soft soil has physical and mechanical characteristics of high water content, high compressibility, low strength and low permeability coefficient, when building high-speed railway roadbeds in areas thereof, though necessary sedimentation control measures have been taken, the problems of longer consolidation period and large post-construction settlement deformation are still very serious, which severely affects the long-term stability and regularity of rail tracks, thus become key issues influencing the safe operation of trains and restricting improvement of high-speed rail service performance of China.

For possible roadbed settlement, steel fasteners are pre-provided on high-speed ballastless track to adjust the track deformation. When roadbed settlement causes that vertical linear of the track changes, fasteners can be adjusted to restore the top surface of the track back to elevation designed. However, a maximum adjustment thereof is merely 15 mm. When the roadbed settlement exceeds 15 mm, the sole adjustment of the fasteners can not do anything to help restore the rail alignment.

In areas where roadbed settlement is seriously over standard, the following three measures are generally taken at present. The first measure is to reduce the speed of the train, which is obviously upsetting because the original intention of high-speed rail construction is violated; the second measure is to remove the track and rebuild the roadbed, which causes long-term disruption of the line and extremely high maintenance cost and is thus not normally adopted; the third measure is to reinforce roadbed by grouting or facilitating high-pressure rotary jet grouting piles, so as to improve the bearing capacity and prevent further settlement. Problems mainly existing in the third measure comprises that:

(1) the third measure is only capable of preventing further developing of settlement, but does not help restore existing roadbed settlement to its original design elevation and therefore cannot achieve real "track uplifting";

(2) the main grouting material is cement-based grout, the slurry consolidation forms rigid bodies in the roadbed, and its modulus of elasticity differs greatly from the roadbed soil, thus producing uncoordinated deformation and inducing cracks and damage;

(3) transportation usually needs to be interrupted, and the railway network operation is affected;

(4) the construction process greatly disturbs the roadbed, and produces large amounts of waste and pollutes the environment;

(5) large construction equipments are used, with a high energy consumption and poor applicability, and has difficulty in entering small sites; and (6) long construction period is required, with a high material consumption and high cost. As can be seen, there is no effective and practical remediation technology concerning the problem of the ballastless track roadbed settlement, which currently affects the safety operational of China's high-speed railway.

It is the "bottleneck" restricting the improvement of high-speed rail transportation service performance.

Polymer grouting technology is a rapid foundation reinforcement technology that developed in the 1970s. This technology, by injecting polymeric materials to the foundation and making use of the characteristics of volume expansion of polymeric materials after chemical reaction, reinforces foundation and fills cavities. At present, polymer grouting technology is mainly used for foundation reinforcement and road maintenance in industrial and civil engineering, so far there is no high-speed rail ballastless track uplifting polymer injection method reported.

SUMMARY OF THE PRESENT INVENTION

In view of the demands for restoring settlement in subgrade of high-speed rails and view of the disadvantages of settlement restoring technique currently, the present invention provides a polymer grouting method for uplifting a ballastless track of a high-speed rail, which has characteristics of fast construction, economical, durable, safe and environmental protection. The polymer grouting method for uplifting the ballastless track of the high-speed rail according to a preferred embodiment of the present invention is capable of achieving uplifting the ballastless track of high-speed rail fastly, and provides an advanced, efficient, economical and practical new-type method for restoring the subgrade settlement in high-speed rails.

In order to accomplish the objects mentioned above, technical solutions adopted by the present invention are as following.

A polymer grouting method for uplifting a ballastless track of a high-speed rail according to a preferred embodiment of the present invention comprises following steps of:

(1) drilling a plurality of grouting holes, wherein the grouting holes which are horizontal are drilled transversely below a concrete bed of a high-speed rail which needs uplifting, and the grouting holes are drilled along a width of the concrete bed plate; a diameter of the grouting holes is 50~80 mm, a length of the grouting holes is the same as the width of the concrete bed plate; and the grouting holes are provided below an axis of each row of track spikes;

(2) manufacturing a plurality of geo-textile bags, binding a grouting pipe up with the geo-textile bags; wherein a number of the geo-textile bags is the same as a number of the grouting holes, a length of the geo-textile bags is the same as the length of the grouting holes, wherein a diameter of the grouting pipe is 16~20 mm, the grouting pipe is placed on an opening of the geo-textile bag, and the opening of the geo-textile bag is sleeved on the grouting pipe, and the opening of the geo-textile bag is fixed on the grouting pipe 6 by a circumferential band;

(3) tying up the geo-textile bags, wherein each of the geo-textile bags are tied up into a plurality of strips;

(4) displacing the geo-textile bags, wherein each of the geo-textile bags is disposed in each of the grouting holes;

(5) grouting into the geo-textile bags, wherein according to a sequence of grouting from two sides to the center, two-component expansive polymer materials are injected into each of the geo-textile bags in sequence by the grouting pipe;

(6) uplifting the ballastless track of the high-speed rail, wherein the two-component expansive polymer materials rapidly expand and solidify in the geo-textile bags, so as to generate a huge expansive force to uplift the settlement of the track;

(7) grouting for filling, wherein spaces among the geo-textile bags which are below the concrete bed of the high-speed rail are grouted two-component expansive polymer materials for filling, so as to ensure uniform contacts between the concrete bed and a ballast bed, the grouting pipe is inserted between two geo-textile bags, an exit of slurry is provided on an axis of the track plate, between the two geo-textile bags which are grouted, the slurry spreads from an axis of the concrete bed to two sides thereof until spreading out of the track plate; and (8) monitoring an amount of the uplifting, wherein a vertically uplifting height is monitored in real time by a laser level, and the grouting is quit if the vertically uplifting height meets uplifting requirements.

According to requirements of uplifting the ballastless track, the polymer grouting method for uplifting the ballastless track of the high-speed rail according to the preferred embodiment of the present invention comprises:

drilling a plurality of grouting holes, wherein the grouting holes which is horizontal are drilled transversely below a concrete bed of a high-speed rail which needs uplifting; and disposing a geo-textile bag into each of the grouting holes, wherein according to a certain sequence of grouting, two-component expansive polymer materials are injected into each of the geo-textile bags in sequence by the grouting pipe;

wherein the two-component expansive polymer materials rapidly expand after a chemical reaction and the geo-textile bags are filled with the two-component expansive polymer materials, and a huge expansive force generated thereof uplifts the bed plate, so as to realize uplifting the track.

Compared with the conventional settlement restoring technique, the polymer grouting method for uplifting the ballastless track of the high-speed rail according to the preferred embodiment of the present invention has the following advantages of:

(1) capable of really achieve uplifting the ballastless track, restoring a elevation height designed of the track, so as to ensure regularity of the track;

(2) small disturbance to the subgrade, wherein with a small size of holes drilled and by a manner of anhydrous grouting, the disturbance to the subgrade during construction process is small;

(3) fast construction and without leaving to grow, wherein the drilling, the grouting and the uplifting is in a continuous operation, the construction is fast, and without leaving to firm, materials is capable of reaching a strength of 90% after reacting for 15 minutes;

(4) economical, wherein compared with other subgrade settlement techniques, the technique of the polymer grouting method for uplifting is capable of saving 50% of the cost thereof;

(5) convenient installation, wherein serialization equipments of polymer grouting are convenient to enter and adapted to various sites, and power consumption in construction is low; and (6) good durability, wherein the polymer grouting material has a stable performance, and since being buried in the ground for a long time, the polymer grouting material has good resistance against chemical solvents and corrosion.

Therefore, the polymer method for uplifting the ballastless track of the high-speed rail provided by the present invention has many advantages in railway settlement restoration projects. Compared with the conventional polymer grouting restoration techniques, the polymer grouting is a set of new technique, which mainly shows in:

(1) grouting materials, which are new type anhydrous polymer grouting materials adopted by the polymer grouting technique for uplifting, which have characteristics such as safe and environmental protection, lightweight, durable, high expansion rate, good impermeability and early strength, and thus the non-water reacted polymer grouting materials are a new type grouting material having good comprehensive performance;

(2) restoration mechanism, wherein the polymer grouting method utilizes the expansive force generated by reaction of the polymer materials to uplift the track, which achieves settlement restoration in a real sense; and (3) construction mode, wherein manners of drilling the grouting holes, disposing the geo-textile bags in the grouting holes, then injecting polymer slurry into the geo-textile bags are capable of effectively controlling a spreading range of the polymer slurry, and avoiding slurry runout and slurry leakage, which is in favor of collecting the expansive force of the slurry and achieving fast uplift.

In conclusion, regarding the restoration materials, the restoration mechanism, and construction mode and etc., the present invention has obvious differences from the conventional grouting method for uplifting. The polymer grouting method for uplifting the ballastless track of high-speed rail of the present invention has advantages such as fast, small disturbance, lightweight, high toughness, economical and durable, has been utilized successfully in uplifting a number of ballastless tracks, and has huge economic benefit, social benefit and broad prospects for development and application.

These and other objectives, features, and advantages of the present invention will become apparent from the following detailed description, the accompanying drawings, and the appended claims.

DETAILED DESCRIPTION OF THE PREFERRED EMBODIMENT

Combined with the accompanying drawings, further description of the present invention is illustrated as following.

Figure 1:
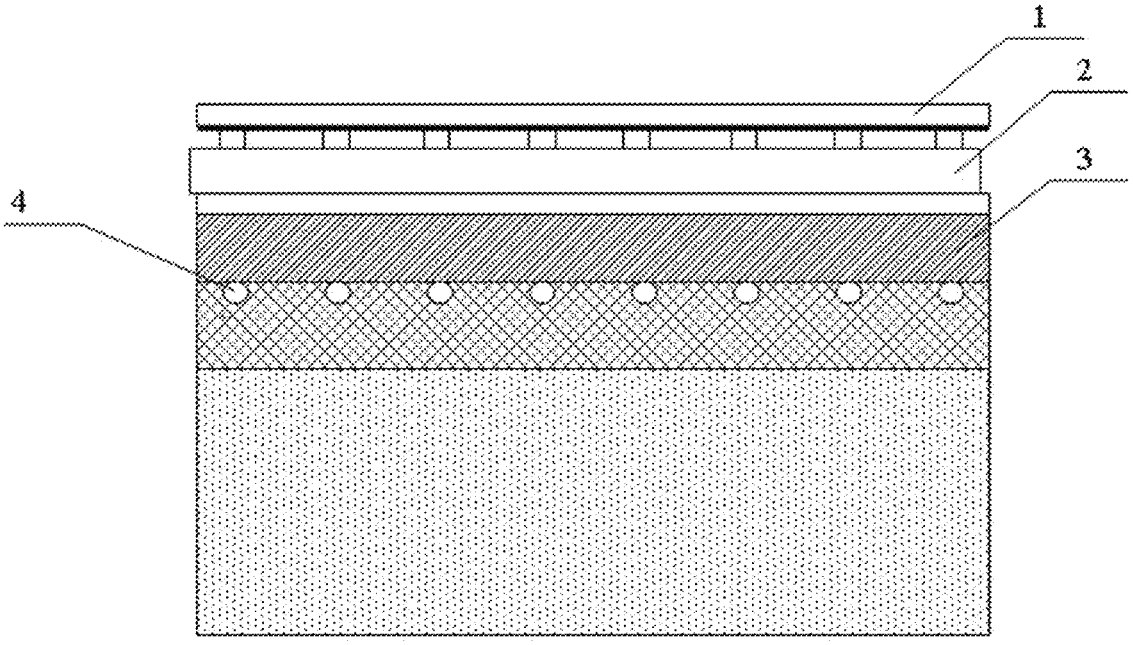
FIG. 1 is a sectional view of grouting holes below a concrete bed plate according to a preferred embodiment of the present invention.
Figure 2:
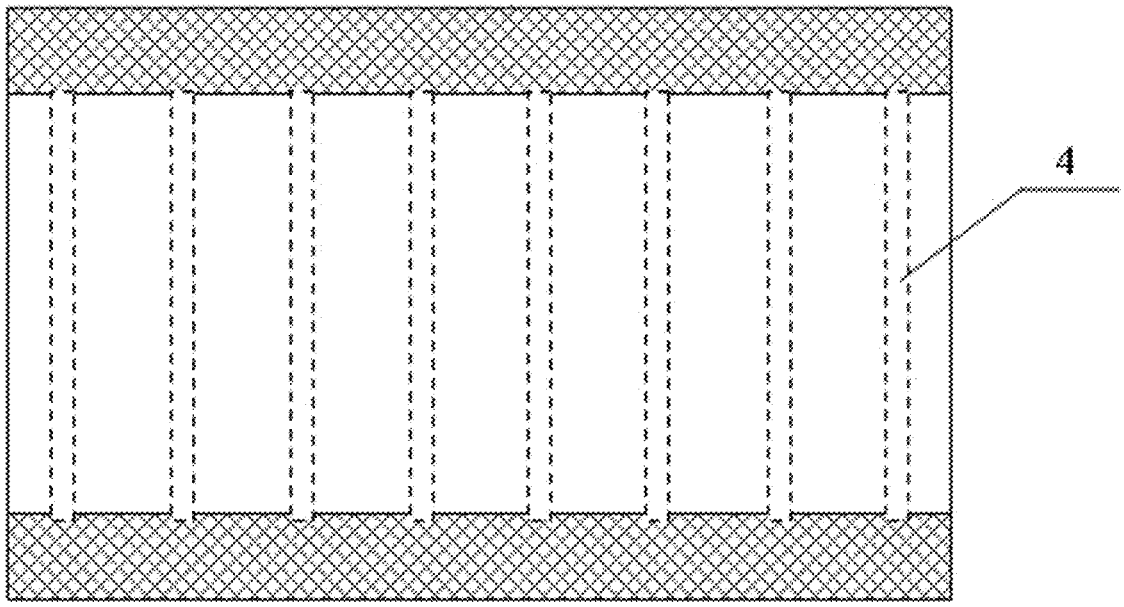
FIG. 2 is a planar distribution view of the grouting holes below the concrete bed plate according to the preferred embodiment of the present invention.
Figure 3:
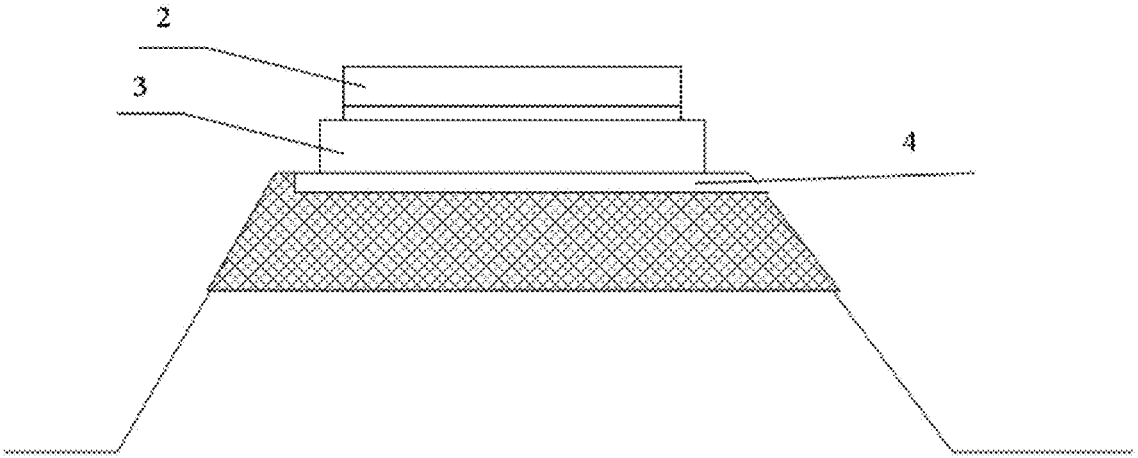
FIG. 3 is a sketch view of drilling the grouting holes below the concrete bed plate according to the preferred embodiment of the present invention.
Figure 4:
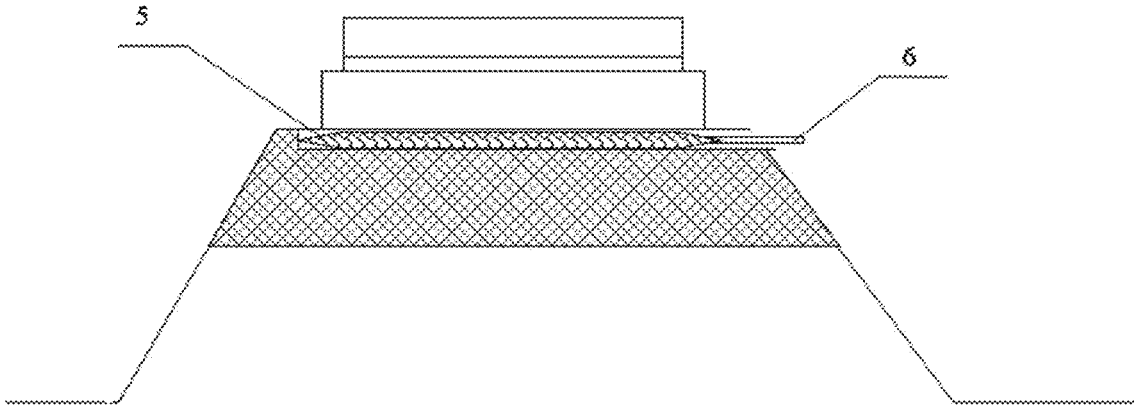
FIG. 4 is a sketch view of disposing geo-textile bags and grouting pipes in the grouting holes according to a preferred embodiment of the present invention.
Figure 5:
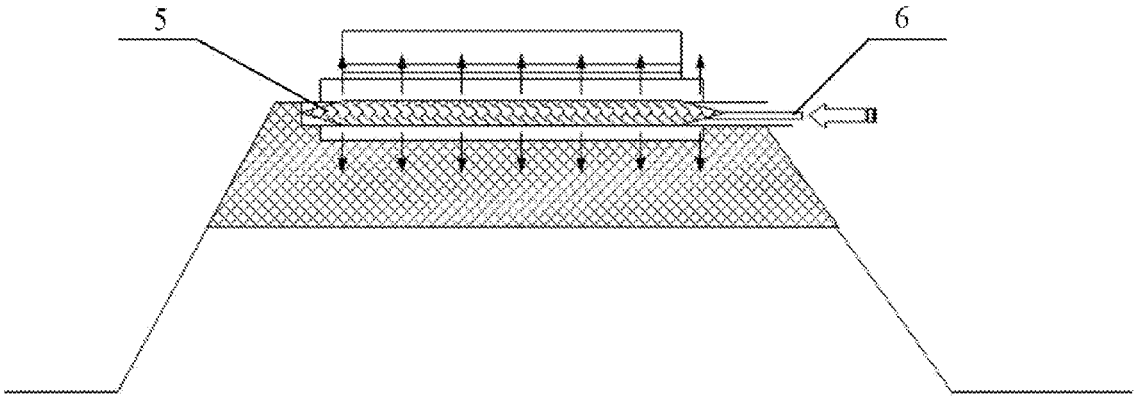
FIG. 5 is a sketch view of grouting into the geo-textile bags to uplift the concrete bed plate according to a preferred embodiment of the present invention.
Figure 6:
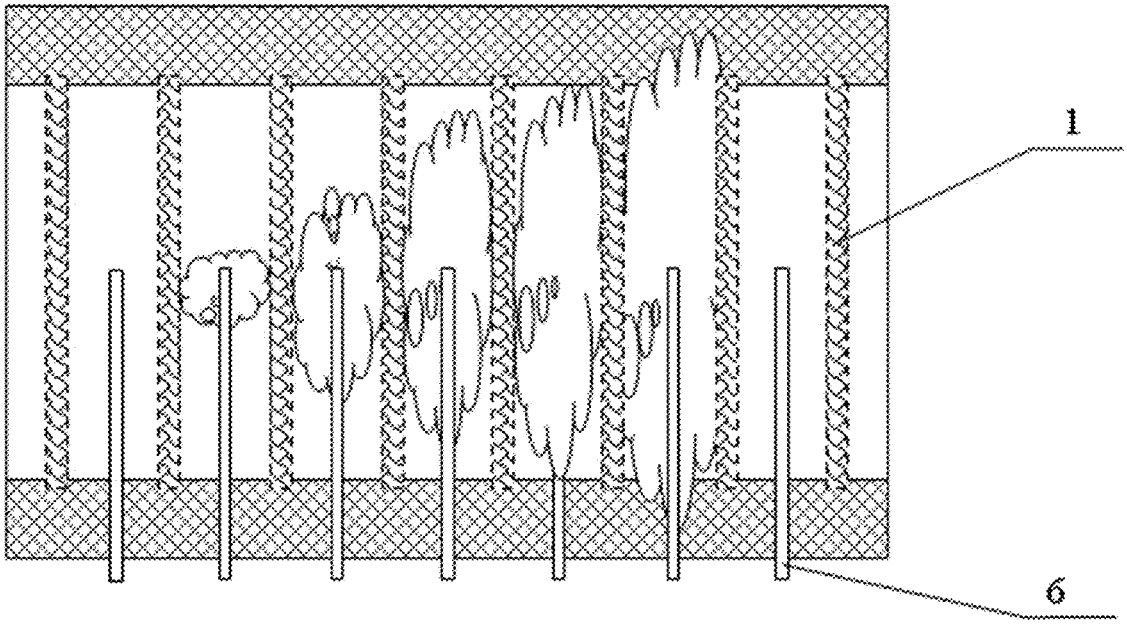
FIG. 6 is a sketch view of grouting for filling between the geo-textile bags below the concrete bed plate according to a preferred embodiment of the present invention.

A polymer grouting method for uplifting a ballastless track of a high-speed rail according to a preferred embodiment of the present invention comprises following steps of:

(1) drilling a plurality of grouting holes 4, wherein referring to FIGS. 1-3, the grouting holes 4 which are horizontal are drilled transversely below a concrete bed 3 of a high-speed rail 1 which needs uplifting, and the grouting holes 4 are drilled along a width of the concrete bed plate 3; the high-speed rail 1 is supported by a track plate 2; a diameter of the grouting holes 4 is 50~80 mm, and preferably 50 mm; a length of the grouting holes 4 is the same as the width of the concrete bed plate 3; and the grouting holes 4 are provided below an axis of each row of track spikes;

(2) manufacturing a plurality of geo-textile bags 5, binding a grouting pipe 6 up with the geo-textile bags 5; wherein a number of the geo-textile bags 5 is the same as a number of the grouting holes 4, a length of the geo-textile bags 5 is the same as the length of the grouting holes 4, wherein a diameter of the grouting pipe 6 is 16~20 mm, the grouting pipe 6 is placed on an opening of the geo-textile bag 5, and the opening of the geo-textile bag is sleeved on the grouting pipe 6, and the opening of the geo-textile bag is fixed on the grouting pipe 6 by a circumferential band;

(3) tying up the geo-textile bags 5, wherein each of the geo-textile bags 5 are tied up into a plurality of strips by adhesive tapes or strings;

(4) displacing the geo-textile bags 5, wherein referring to FIG. 4 of the drawings, each of the geo-textile bags 5 is disposed in each of the grouting holes 4;

(5) grouting into the geo-textile bags 5, wherein referring to FIG. 5 of the drawings, according to a sequence of grouting from two sides to the center, two-component expansive polymer materials are injected into each of the geo-textile bags 5 in sequence by the grouting pipe 6;

(6) uplifting the ballastless track of the high-speed rail, wherein referring to FIG. 5 of the drawings, the two-component expansive polymer materials rapidly expand and solidify in the geo-textile bags 5, so as to generate a huge expansive force to uplift the settlement of the track;

(7) grouting for filling, wherein referring to FIG. 6 of the drawings, spaces among the geo-textile bags 5 which are below the concrete bed 3 of the high-speed rail 1 are grouted for filling, so as to ensure uniform contacts between the concrete bed 3 and a ballast bed, the grouting pipe is inserted between two geo-textile bags 5, an exit of slurry is provided on an axis of the track plate 2, between the two geo-textile bags 5 which are grouted, the slurry spreads from an axis of the concrete bed 3 to two sides thereof until spreading out of the track plate 2; and (8) monitoring an amount of the uplifting, wherein a vertically uplifting height is monitored in real time by a laser level, and the grouting is quit if the vertically uplifting height meets uplifting requirements.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A polymer grouting method for uplifting a ballastless track of a high-speed rail comprising following steps of:

(1) drilling a plurality of grouting holes, wherein the grouting holes which are horizontal are drilled transversely below a concrete bed of the high-speed rail which needs uplifting, and the grouting holes are drilled along a width of a concrete bed plate; a diameter of the grouting holes is at a range of 50~80 mm, a length of the grouting holes is the same as the width of the concrete bed plate; and the grouting holes are provided below an axis of each row of track spikes;

(2) manufacturing a plurality of geo-textile bags, binding a grouting pipe up with the geo-textile bags; wherein a number of the geo-textile bags is the same as a number of the grouting holes, a length of the geo-textile bags is the same as the length of the grouting holes, wherein a diameter of the grouting pipe is at a range of 16~20 mm, the grouting pipe is placed on an opening of the geo-textile bag, and the opening of the geo-textile bag is sleeved on the grouting pipe, and the opening of the geo-textile bag is fixed on the grouting pipe by a circumferential band;

(3) tying up the geo-textile bags, wherein each of the geo-textile bags are tied up into a plurality of strips;

(4) displacing the geo-textile bags, wherein each of the geo-textile bags is disposed in each of the grouting holes;

(5) grouting into the geo-textile bags, wherein according to a sequence of grouting from two sides to the center, two-component expansive polymer materials are injected into each of the geo-textile bags in sequence by the grouting pipe;

(6) uplifting the ballastless track of the high-speed rail, wherein the two-component expansive polymer materials rapidly expand and solidify in the geo-textile bags, so as to generate a huge expansive force to uplift the settlement of the track;

(7) grouting for filling, wherein spaces among the geo-textile bags which are below the concrete bed of the high-speed rail are grouted for filling, so as to ensure uniform contacts between the concrete bed and a ballast bed, the grouting pipe is inserted between two geo-textile bags, an exit of slurry is provided on an axis of the track plate, between the two geo-textile bags which are grouted, the slurry spreads from an axis of the concrete bed to two sides thereof until spreading out of the track plate; and (8) monitoring an amount of the uplifting, wherein a vertically uplifting height is monitored in real time by a laser level, and the grouting is quit if the vertically uplifting height meets uplifting requirements.

* * * * *